US009835157B2

(12) United States Patent
Horibe et al.

(10) Patent No.: US 9,835,157 B2
(45) Date of Patent: Dec. 5, 2017

(54) ROTOR WITH A RESIN LAYER THAT HAS CIRCULAR OR SPIRAL GROOVES

(71) Applicant: TAIHO KOGYO Co., Ltd., Toyota-shi, Aichi (JP)

(72) Inventors: Naoki Horibe, Toyota (JP); Masanori Akizuki, Toyota (JP); Hiroshi Kanemitsu, Toyota (JP)

(73) Assignee: Taiho Kogyo Co., Ltd. (JP)

( * ) Notice: Subject to any disclaimer, the term of this patent is extended or adjusted under 35 U.S.C. 154(b) by 0 days.

(21) Appl. No.: 14/892,939

(22) PCT Filed: Feb. 19, 2015

(86) PCT No.: PCT/JP2015/054668
§ 371 (c)(1),
(2) Date: Nov. 20, 2015

(87) PCT Pub. No.: WO2015/125888
PCT Pub. Date: Aug. 27, 2015

(65) Prior Publication Data

US 2016/0108916 A1 Apr. 21, 2016

(30) Foreign Application Priority Data

Feb. 21, 2014 (JP) ..... 2014-032141

(51) Int. Cl.
*F04C 18/344* (2006.01)
*F01C 21/10* (2006.01)
(Continued)

(52) U.S. Cl.
CPC ..... *F04C 18/3441* (2013.01); *F01C 21/10* (2013.01); *F01C 21/108* (2013.01);
(Continued)

(58) Field of Classification Search
CPC .... F01C 21/108; F01C 21/10; F04C 2230/91; F04C 18/322; F04C 18/3441; F04C 18/3564; F04C 2240/54
See application file for complete search history.

(56) References Cited

U.S. PATENT DOCUMENTS 5,310,326 A 5/1994 Gui et al.
7,878,777 B2 2/2011 Iwanami et al.
(Continued)

FOREIGN PATENT DOCUMENTS

EP 2 224 093 A1 9/2010
EP 2 657 527 A1 10/2013
(Continued)

OTHER PUBLICATIONS

Office Action for Chinese Patent Application No. 201580001392.6 dated Sep. 2, 2016 and translation (12 pages).
(Continued)

*Primary Examiner* — Mary A Davis
(74) *Attorney, Agent, or Firm* — Harness, Dickey & Pierce, P.L.C.

(57) ABSTRACT

First closing plate and second closing plate close opening portions at both ends of cylindrical member in an axial direction. Base is housed in a space formed by cylindrical member, first closing plate, and second closing plate, and rotates around an axis in the same direction as the axial direction of cylindrical member. Resin layers are formed on thrust surfaces of base. Groove C is a plurality of concentric circular grooves or a spiral groove formed on each resin layer, and the center of circles of the circular grooves or the center of a spiral of the spiral groove is different from the rotation center of base.

4 Claims, 5 Drawing Sheets

(51) Int. Cl.

| | |
|---|---|
| ***F04C 18/32*** | (2006.01) |
| ***F04C 18/356*** | (2006.01) |
| ***F04C 29/02*** | (2006.01) |
| ***F04C 29/12*** | (2006.01) |

(52) U.S. Cl.
CPC ..... *F04C 29/02* (2013.01); *F04C 29/124* (2013.01); *F04C 18/322* (2013.01); *F04C 18/3564* (2013.01); *F04C 2230/91* (2013.01); *F04C 2240/54* (2013.01); *F05C 2251/14* (2013.01); *F05C 2253/20* (2013.01)

(56) References Cited

U.S. PATENT DOCUMENTS

| | | | | |
|---|---|---|---|---|
| 9,506,499 | B2 * | 11/2016 | Nomura | F04C 18/02 |
| 2010/0263404 | A1 | 10/2010 | Shiotani et al. | |
| 2013/0129552 | A1 | 5/2013 | Goto et al. | |
| 2013/0280116 | A1 | 10/2013 | Hayashi et al. | |
| 2016/0238007 | A1 * | 8/2016 | Kanemitsu | F04C 18/0284 |

FOREIGN PATENT DOCUMENTS

| | | | |
|---|---|---|---|
| JP | S47-030008 | U | 12/1972 |
| JP | S5479809 | A | 6/1979 |
| JP | S5518545 | Y2 | 4/1980 |
| JP | S6314200 | B2 | 3/1988 |
| JP | 2004278309 | A | 10/2004 |
| JP | 2004316533 | A | 11/2004 |
| JP | 2008-051018 | A | 3/2008 |
| JP | 2012-137008 | A | 7/2012 |
| JP | 2012-137012 | A | 7/2012 |
| KR | 2013-0027565 | A | 3/2013 |
| WO | WO-2009066413 | A1 | 5/2009 |

OTHER PUBLICATIONS

Office Action for European Patent Application No. EP15752416.6 dated Nov. 24, 2016 (4 pages).

* cited by examiner

ROTOR WITH A RESIN LAYER THAT HAS CIRCULAR OR SPIRAL GROOVES

CROSS-REFERENCE TO RELATED APPLICATIONS

This application is a U.S. National Phase Application under 35 U.S.C. 371 of International Application No. PCT/JP2015/054668, filed Feb. 19, 2015 and published in Japanese as WO2015/125888 A1 on Aug. 27, 2015. This application claims priority to Japanese Patent Application 2014-032141, filed on Feb. 21, 2014. The entire disclosures of the above applications are incorporated herein by reference.

TECHNICAL FIELD

The present invention relates to rotors and rotary fluid machines.

RELATED ART

Rotary fluid machines are known that suction and discharge fluid by moving a rotor and a vane within a space formed by closing both ends of a cylinder. Regarding these rotary fluid machines, there has been a demand for preventing seizure and abrasion of the rotor. As a technique for solving this problem, for example, Patent Document 1 describes a rotary compression machine having a modified surface layer, which is formed by modifying both or one of the inner circumference of the cylinder and the outer circumference of the rotor using sulphonitriding treatment or sulfurizing treatment.

SUMMARY

Technical Problem

With the technique described in JP 2004-278309A, an oil film cannot be easily formed on a thrust surface of the rotor, and therefore, there has been a problem in that a leakage loss and consumption of motive power at the time of compression increase.

The present invention provides a technique that facilitates formation of an oil film on a thrust surface of a rotor so that a leakage loss and consumption of motive power at the time of compression can be reduced.

Solution to Problem

The present invention provides a rotor including: a base housed in a space formed by a cylindrical member and a closing plate that closes an opening portion at each of both ends of the cylindrical member in an axial direction, the base rotating around an axis in the same direction as the axial direction; a resin layer formed on a thrust surface of the base; and a plurality of concentric circular grooves or a spiral groove formed on the resin layer, the center of circles of the circular grooves or the center of a spiral of the spiral groove being different from a rotation center of the base.

An amount of eccentricity of the center of the circles of the circular grooves or an amount of eccentricity of the center of the spiral of the spiral groove relative to the rotation center of the base may be greater than or equal to a groove pitch.

The present invention also provides a rotary fluid machine including: a cylindrical member; a closing plate that closes opening portions at both ends of the cylindrical member in an axial direction; and the above-described rotor.

Effects of the Invention

According to the present invention, formation of an oil film on a thrust surface of a rotor is facilitated, and thus, a leakage loss and consumption of motive power at the time of compression can be reduced.

DESCRIPTION

Figure 1:
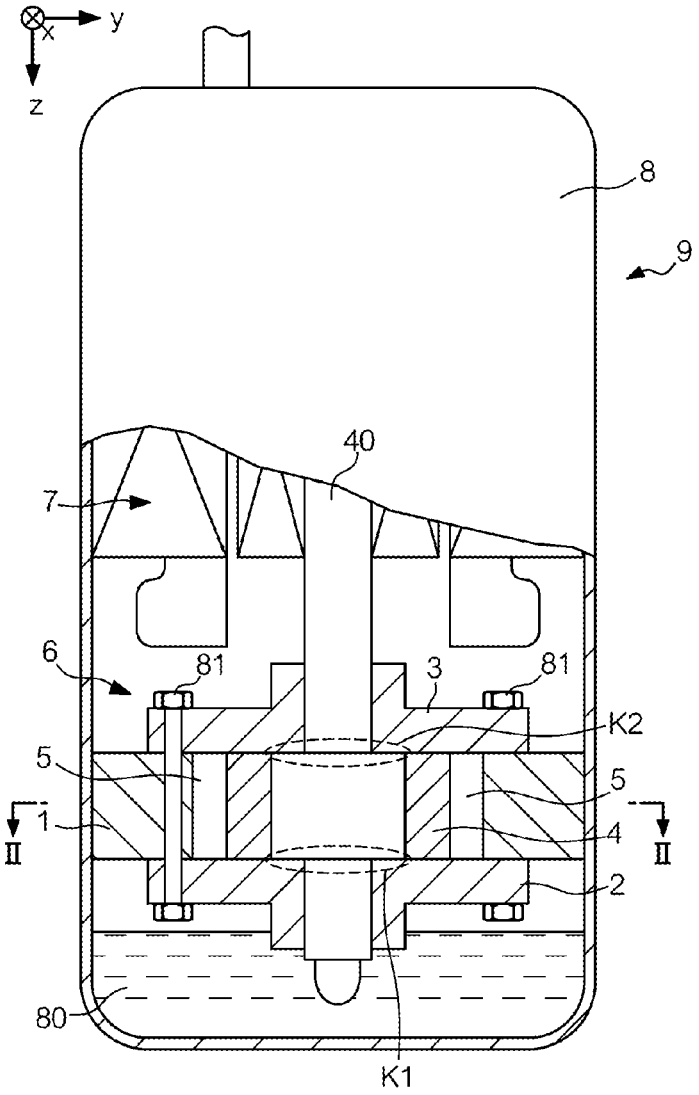
FIG. 1 is a partial cross-sectional view showing a rotary compression machine according to an embodiment.

1. Embodiment (Structure of Rotary Compression Machine)

Hereinafter, in the drawings, the space in which each configuration of rotary compression machine 9 is arranged will be shown as an xyz right-handed coordinate system in order to describe the arrangement of the configuration. Among coordinate signs shown in the drawings, a circle sign that is white on the inside with a black circle therein indicates an arrow extending from the distal side toward the proximal side of paper. A circle sign that is white on the inside and in which two intersecting lines are drawn indicates an arrow extending from the proximal side toward the distal side of paper. In the space, a direction parallel with an x-axis will be referred to as an x-axis direction. Of the x-axis direction, a direction in which the x component increases will be referred to as a +x direction, and a direction in which the x component decreases will be referred to as a −x direction. Regarding y and z components as well, a y-axis direction, a +y direction, a −y direction, a z-axis direction, a +z direction, and a −z direction are defined in conformity to the above definition.

FIG. 1 is a partial cross-sectional view showing rotary compression machine 9 according to an embodiment of the present invention. Rotary compression machine 9 is an example of a rotary fluid machine according to the present invention, and is used to compress gas such as coolant gas in air conditioning machines for, for example, automobiles, household, railways, or business use. Rotary compression machine 9 is provided with motor 7 that is housed in an upper part within closed casing 8 and serves as a driving source, and compression mechanism 6 that is arranged in a lower part within closed casing 8 and driven by motor 7 mentioned above to suction and discharge coolant gas.

Figure 2:
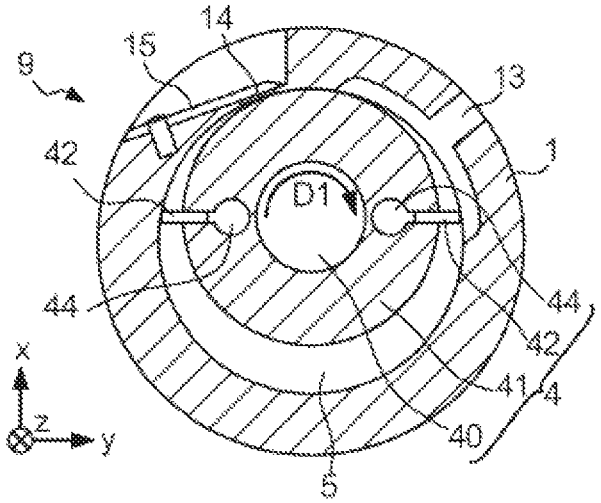
FIG. 2 is a cross-sectional view of compression mechanism 6 as viewed along arrows II-II shown in FIG. 1.

FIG. 2 is a cross-sectional view of compression mechanism 6 as viewed along arrows II-II shown in FIG. 1. Compression mechanism 6 is a compression mechanism using a so-called rotary vane system (sliding vane system).

Compression mechanism 6 has a cylindrical member (hereinafter referred to as cylindrical member 1) having an axis in the up-down direction (z-axis direction) in FIG. 1, first closing plate 2 that closes an end face and an opening portion (hereinafter referred to as first opening portion K1) on the lower side of cylindrical member 1, second closing plate 3 that closes an end face and an opening portion (hereinafter referred to as second opening portion K2) on the upper side of cylindrical member 1, and operation portion 4. Cylindrical member 1 is a so-called cylinder. Operation chamber 5 is formed within cylindrical member 1 by sandwiching cylindrical member 1 from both sides in the axial direction thereof (i.e., from above and below in FIG. 1) using first closing plate 2 and second closing plate 3 and fastening a plurality of portions of cylindrical member 1 in the circumferential direction with a plurality of bolts 81.

Operation portion 4 has driving shaft 40, rotor 41, vanes 42, and vane grooves 44. Although vanes 42 are provided at two portions in the example shown in FIG. 2, vane 42 may be provided at a single portion, or vanes 42 may be provided at three or more portions. Driving shaft 40, which passes through holes provided in first closing plate 2 and second closing plate 3 and leads to the outside of operation chamber 5, penetrates the inner circumferential side of rotor 41. Driving shaft 40 is connected to motor 7, and driving shaft 40 and rotor 41 rotate in the D1 direction by the driving force of motor 7. Lubricating oil 80 is stored in a lower part within closed casing 8, and when rotor 41 is rotated, lubricating oil 80 is supplied to an inner circumferential face and an outer circumferential face of rotor 41 via an oil passage (not shown) formed within a lower end portion of driving shaft 40.

Driving shaft 40 and rotor 41 rotate around the same axis, whereas the center of driving shaft 40 and the center of the inner circumference of cylindrical member 1 are different. Therefore, a hoof-shaped space (operation chamber 5) shown in FIG. 2 is formed between rotor 41 and an inner circumferential face of cylindrical member 1. Rotor 41 is provided with vane grooves 44 that house vanes 42, and vanes 42 project from vane grooves 44 due to backing pressure and receive force in a direction toward the inner circumferential face of cylindrical member 1. With the rotation of rotor 41, tips of vanes 42 move along vane grooves 44 while coming into contact with the inner circumferential face of cylindrical member 1. For this reason, operation chamber 5 is partitioned into a plurality of cells by vanes 42, and fluid that fills each cell moves from suction port 13 to discharge port 14. As each vane 42 approaches discharge port 14, the internal pressure of operation chamber 5 partitioned by vane 42 increases. When the internal pressure exceeds discharge pressure, the fluid that fills the inside of operation chamber 5 is discharged from discharge port 14 against discharge valve 15.

Figure 3:
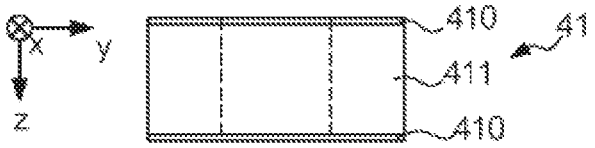
FIG. 3 is a side view of rotor 41.

FIG. 3 is a side view of rotor 41. Rotor 41 has a cylindrical base 411, and resin layers 410 formed on surfaces (hereinafter referred to as thrust surfaces) of base 411 each opposed to first closing plate 2 or second closing plate 3. Resin layers 410 contain, as binder resin, at least one of, for example, polyamide-imide resin, polyimide resin, diisocyanate modification and BPDA modification of these resins, sulfone-modified resin, epoxy resin, polyetheretherketone resin, phenolic resin, polyamide, and elastomer. Resin layers 410 also contain, as a solid lubricant, at least one of, for example, graphite, carbon, molybdenum disulfide, polytetrafluoroethylene, boron nitride, tungsten disulfide, fluororesin, and soft metal (e.g., Sn or Bi). Base 411 may be made of cast iron, or may be formed by performing various kinds of treatment, such as sintering, forging, cutting, pressing, and welding, on any kind of material such as aluminum or stainless steel. Base 411 may be made of ceramic, or may be made of resin.

Figure 4:
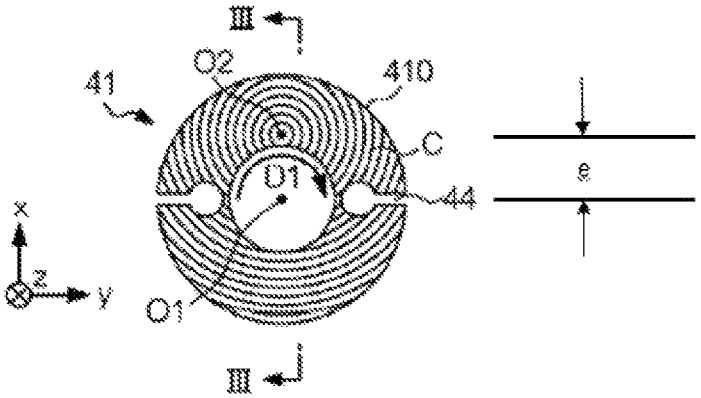
FIG. 4 is a plan view of rotor 41.

FIG. 4 is a plan view of rotor 41. A plurality of concentric circular grooves C are formed on each resin layer 410. Center O2 of the circles of grooves C is located at a position different form rotation center O1 of rotor 41 (shaft center of driving shaft 40). It is desirable that the amount of eccentricity of center O2 of grooves C relative to rotation center O1 of rotor 41 is greater than or equal to a single pitch of grooves C (in the case where grooves C are arranged at equal intervals).

Figure 5:
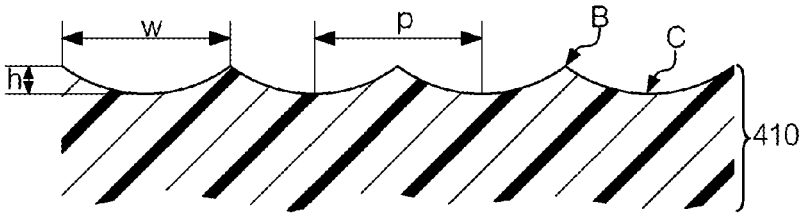
FIG. 5 is a cross-sectional view of grooves C as viewed along arrows III-III shown in FIG. 4.

FIG. 5 is a cross-sectional view of grooves C as viewed along arrows III-III shown in FIG. 4. The cross-section of each groove C has a shape resembling a U-shape or a semi-circle with a width that is narrower at a deeper position and changes more sharply on the side closer to the bottom. Grooves C are formed by moving an edge of a cutting tool along the surface of each resin layer 410. Width w of each groove C is the width of groove C in a cross-section orthogonal to the extending direction of groove C, and is the length of a line connecting both end portions of groove C in this cross-section. Interval P of the grooves, i.e., the pitch of the grooves, is the interval between two adjoining grooves C, and is the length of a line connecting the centers of these grooves C in a cross-section orthogonal to the extending direction of grooves C. Interval p is, for example, 0.1 to 0.15 mm. In this example, width w of each groove C is the same as interval p of grooves C.

In this embodiment, each crest portion B formed on resin layers 410 comes into line contact with first closing plate 2 or second closing plate 3. Here, since center O2 of grooves C is located at a position different from rotation center O1 of rotor 41, the direction of a tangent line at each point of grooves C is different from the rotation direction of rotor 41 (except a point on a line passing through center O2 and rotation center O1). For this reason, lubricating oil 80 is drawn into spaces between crest portions B and first and second closing plates 2 and 3 due to a wedge effect (also called a wedge-film effect), facilitating formation of oil films. Accordingly, according to this embodiment, air tightness and lubricity at contact portions between resin layers 410 and first and second closing plates 2 and 3 increase as compared with a case where center O2 of grooves C is located at the same position as rotation center O1 of rotor 41.

2. Modifications

The embodiment is as described above, whereas the content of this embodiment may be modified as follows. The following modifications may also be combined.

2-1. Application Example

The above-described embodiment mentions air conditioning machines for automobiles, household, railways, or business use as apparatuses to which rotary compression machine 9 is to be applied. However, rotary compression machine 9 may also be applied to freezing chambers, refrigerating apparatuses, and the like, and may also be used in various kinds of apparatuses such as water temperature adjustment, thermostat bathes, humidistat bathes, painting equipment, powder conveying apparatuses, food processing apparatuses, and air separators. Although the above-described embodiment takes rotary compression machine 9 as an example of the rotary fluid machine according to the present invention, in addition, a rotary air blower that deals with gas, a rotary pump that deals with liquid, and the like can also be considered to be the rotary fluid machine according to the present invention.

2-2. Modification 1

Figure 6:
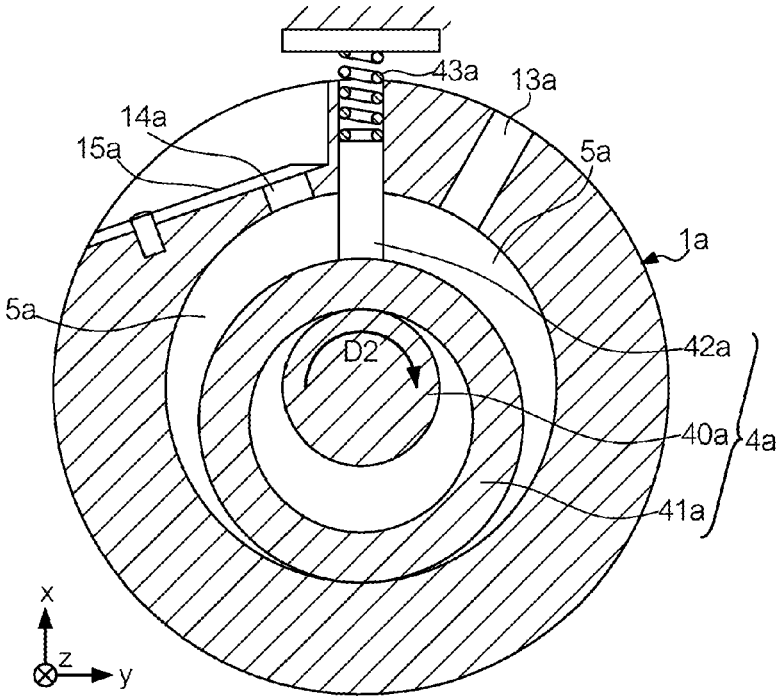
FIG. 6 is a diagram showing a modification of a rotary fluid machine.

FIG. 6 is a diagram showing a modification of a rotary fluid machine. Operation portion 4*a* has driving shaft 40*a*, rotor 41, and vane 42*a*. Driving shaft 40*a* is provided with an eccentric portion (not shown) having a circular column shape whose center is an axis different from the axis of driving shaft 40*a* itself, and this eccentric portion is fitted into the inner circumferential side of rotor 41*a* (so-called rolling piston). For this reason, upon driving shaft 40*a* rotating, rotor 41*a* accordingly rotates eccentrically along an inner circumferential face of cylindrical member 1*a*.

Vane 42*a* is a member having a plate shape (plate-shaped member) that extends from the inner circumferential face of cylindrical member 1*a* and is in contact with an outer circumferential face of rotor 41*a*. Vane 42*a* projects from the inner circumferential face of cylindrical member 1*a* due to spring 43*a* and receives force in a direction toward driving shaft 40*a*, and a tip of vane 42*a* presses the outer circumferential face of rotor 41*a* due to this force. Operation chamber 5*a*, which is a space formed between rotor 41*a* and cylindrical member 1*a*, is partitioned by vane 42*a* that presses the outer circumferential face of rotor 41*a*.

Suction port 13*a* is an opening portion provided in the inner circumferential face of cylindrical member 1*a*, and causes coolant gas to be suctioned from the outside into operation chamber 5*a*. Upon operation portion 4*a* rotating clockwise along arrow D2, the space in operation chamber 5*a* partitioned by the outer circumferential face of rotor 41*a* moves clockwise along the inner circumferential face of cylindrical member 1*a*. Discharge port 14*a* is closed by discharge valve 15*a* when the internal pressure of operation chamber 5*a* is smaller than predetermined discharge pressure. When the internal pressure of operation chamber 5*a* becomes greater than or equal to the discharge pressure, the coolant gas is discharged from discharge port 14*a*.

In this modification as well, as in the above-described embodiment, a plurality of concentric circular grooves are formed on the resin layers provided on the thrust surfaces of rotor 41*a*, thereby facilitating formation of oil films between the resin layers and the first and second closing plates. However, in this modification, rotor 41*a* eccentrically rotates, and therefore the wedge effect is generated regardless of the position of the center of the groove circles. Accordingly in this modification, the position of the center of the groove circles is not limited.

2-3. Modification 2

Figure 7:
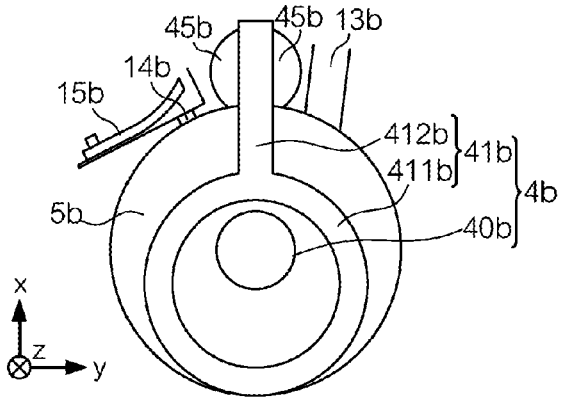
FIG. 7 is a diagram showing a modification of a rotary fluid machine.

FIG. 7 is a diagram showing a modification of a rotary fluid machine. In this case, swing bushes 45*b* are provided on an inner circumferential face of cylindrical member 1*b*. Operation portion 4*b* has driving shaft 40*b* and rotor 41*b*. Rotor 41*b* is a so-called swing piston and has a plate-shaped member (hereinafter referred to as "plate-shaped member 412*b*") and a cylindrical base (hereinafter referred to as "cylindrical base 411*b*"). Plate-shaped member 412*b* is sandwiched by swing bushes 45*b*, thereby maintaining air tightness. That is to say, plate-shaped member 412*b* is integrally provided with cylindrical base 411*b*, extends from an outer circumferential face of cylindrical base 411*b* toward the inner circumferential face of the cylindrical member, and is sandwiched by swing bushes 45*b* provided in this inner circumferential face. Operation chamber 5*b* shown in FIG. 7 is provided between rotor 41*b* and the inner circumferential face of cylindrical member 1*b*, and this operation chamber 5*b* is partitioned by plate-shaped member 412*b*.

Driving shaft 40*b* has an eccentric portion, and this eccentric portion is fitted into an inner circumferential face of cylindrical base 411*b* of rotor 41*b*. For this reason, upon driving shaft 40*b* rotating, rotor 41*b* swings. Thereby, the position at which operation chamber 5*b* is partitioned by plate-shaped member 412*b* and cylindrical base 411*b* is moved, fluid that fills each partitioned chamber moves from suction port 13*b* to discharge port 14*b*, and the internal pressure of operation chamber 5*b* increase. When the internal pressure exceeds discharge pressure, the fluid is discharged from discharge port 14*b* against discharge valve 15*b*.

Note that FIG. 7 does not show the entire body of cylindrical member 1*b*, but shows parts (inner circumferential face, suction port 13*b*, discharge port 14*b*, and discharge valve 15*b*) thereof. In order to also maintain air tightness at plate-shaped member 412*b* held by swing bushes 45*b*, it is more favorable to provide a recess portion in an area where swing bushes 45*b* and plate-shaped member 412*b* are present and form a resin layer. Although the shape of cylindrical member 1*b* is a cylindrical shape, it is not limited to a cylindrical shape, but may be any kind of tubular shape. For example, the cross-section thereof may be an ellipse.

In this modification as well, as in the above-described embodiment, a plurality of concentric circular grooves are formed on the resin layers provided on the thrust surfaces of cylindrical base 411*b*, thereby facilitating formation of oil films between the resin layers and the first and second closing plates. However, in this modification, cylindrical base 411*b* swings, and accordingly the wedge effect is generated regardless of the position of the center of the groove circles. Accordingly in this modification, the position of the center of the groove circles is not limited.

2-4. Modification 3

Figure 8:
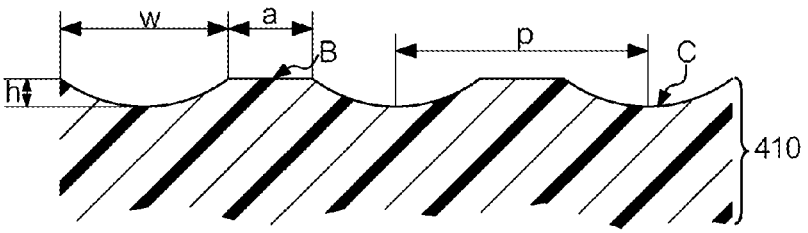
FIG. 8 is a diagram showing a modification of grooves C.

FIG. 8 is a diagram showing a modification of grooves C. In this example, width w of each groove C is smaller than interval p between grooves C ($w<p$). Each crest portion B is provided with a flat surface having width a between grooves C. In this case, it is desirable that width a is smaller than width w ($a<w$). By setting width a smaller than width w, grooves C will not be completely filled by crest portions B that come into contact with operation portion 4 and undergo elastic deformation. That is to say, even if crest portions B undergo elastic deformation toward grooves C, grooves C retain lubricating oil 80, and accordingly the air tightness of the rotary fluid machine increases.

It is also desirable that depth h of each groove C is smaller than interval p between adjoining grooves C ($h<p$). In this case, of crest portions B formed between adjoining grooves C, the width of a skirt portion corresponding to interval p is longer than the height corresponding to depth h of each groove C. Accordingly, crest portions B have a relatively strong shape with respect to lateral force in FIG. 8. Depth h is 1 to 20 μm, for example.

2-5. Modification 4

In the above-described embodiment, the cross-sectional shape of base 411 in a plane vertical to driving shaft 40 is a circle. However, the cross-sectional shape of base 411 is not limited to a circle. The cross-sectional shape of base 411 may be, for example, an ellipse, a shape of constant-width such as a Reuleaux polygon, or a shape combining a semi-circle and an ellipse.

2-6. Modification 5

Figure 9:
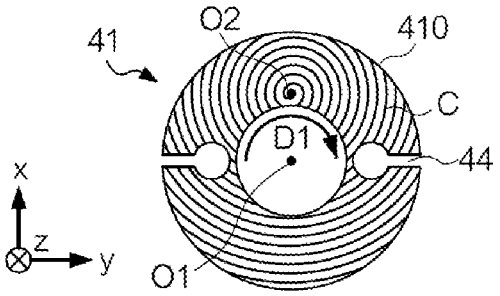
FIG. 9 is a plan view showing a modification of rotor 41.

In the above-described embodiment, grooves C are concentric circular grooves. However, as shown in FIG. 9, groove C may have a spiral shape. In this case, since the wedge effect is generated even if the center of the spiral of groove C coincides with the rotation center of rotor 41, the center of the spiral of groove C may coincide with the rotation center of rotor 41. However, a greater wedge effect is obtained as a whole when the center of the spiral of groove C is different from the rotation center of rotor 41. Accordingly, it is desirable that the center of the spiral of groove C is different from the rotation center of rotor 41. It is also desirable that the amount of eccentricity of the center of the spiral of groove C relative to the rotation center of rotor 41 is greater than or equal to a single pitch of the spiral of groove C (in the case where the pitch of the spiral of groove C is constant).

2-7. Modification 6

Although the above-described embodiment does not mention the area in which the plurality of grooves C are formed in the resin layers 410, grooves C do not have to be formed over the entire resin layers 410, and grooves C may be formed in a part of resin layers 410. Grooves C may be formed on one of resin layers 410 provided on the two thrust surfaces.

What is claimed is:

1. A rotor housed in a space formed by a cylindrical member and closing plates that close an opening at each end of the cylindrical member in an axial direction, the rotor comprising:

a base, the base rotating around an axis, the axis extending in the same direction as the axial direction;

a resin layer formed on a thrust surface of the base; and a plurality of concentric circular grooves or a spiral groove formed in the resin layer, the center of circles of the circular grooves or the center of a spiral of the spiral groove being different from a center of the base about which the base rotates.

2. The rotor according to claim 1, wherein an amount of eccentricity of the center of the circles of the circular grooves or an amount of eccentricity of the center of the spiral of the spiral groove relative to the center of the base is greater than or equal to a groove pitch of the circular grooves or the spiral groove.

3. A rotary fluid machine comprising:

a cylindrical member;

closing plates that close an opening at each end of the cylindrical member in an axial direction; and a rotor housed in a space formed by the cylindrical member and the closing plates, the rotor including:

a base, the base rotating around an axis, the axis extending in the same direction as the axial direction;

a resin layer formed on a thrust surface of the base; and a plurality of concentric circular grooves or a spiral groove formed in the resin layer, the center of circles of the circular grooves or the center of a spiral of the spiral groove being different from a center of the base about which the base rotates.

4. The rotor according to claim 3, wherein an amount of eccentricity of the center of the circles of the circular grooves or an amount of eccentricity of the center of the spiral of the spiral groove relative to the center of the base is greater than or equal to a groove pitch of the circular grooves or the spiral groove.

* * * * *